US009336791B2

(12) United States Patent
Li et al.

(10) Patent No.: US 9,336,791 B2
(45) Date of Patent: May 10, 2016

(54) REARRANGEMENT AND RATE ALLOCATION FOR COMPRESSING MULTICHANNEL AUDIO

(71) Applicants: Minyue Li, Beijing (CN); Jan Skoglund, Mountain View, CA (US); Willem Bastiaan Kleijn, Lower Hutt (NZ)

(72) Inventors: Minyue Li, Beijing (CN); Jan Skoglund, Mountain View, CA (US); Willem Bastiaan Kleijn, Lower Hutt (NZ)

(73) Assignee: GOOGLE INC., Mountain View, CA (US)

( * ) Notice: Subject to any disclaimer, the term of this patent is extended or adjusted under 35 U.S.C. 154(b) by 461 days.

(21) Appl. No.: 13/749,399

(22) Filed: Jan. 24, 2013

(65) Prior Publication Data

US 2014/0207473 A1 Jul. 24, 2014

(51) Int. Cl.
*G10L 21/00* (2013.01)
*G10L 19/008* (2013.01)

(52) U.S. Cl.
CPC ..... *G10L 21/00* (2013.01); *G10L 19/008* (2013.01)

(58) Field of Classification Search
CPC ..... G10L 21/00; G10L 19/008
USPC ..... 348/14.01; 370/229, 535, 537; 375/240.02, 371, 240.26; 381/23, 98, 381/103; 704/200.1, 219, 225, 500, 205, 704/206, 501; 707/705, 796; 714/752; 700/94
See application file for complete search history.

(56) References Cited

U.S. PATENT DOCUMENTS

| | | | | |
|---|---|---|---|---|
| 5,185,800 | A * | 2/1993 | Mahieux | 704/500 |
| 5,752,224 | A * | 5/1998 | Tsutsui et al. | 704/225 |
| 5,870,703 | A * | 2/1999 | Oikawa et al. | 704/200.1 |
| 6,339,757 | B1 * | 1/2002 | Teh et al. | 704/219 |
| 6,405,338 | B1 * | 6/2002 | Sinha et al. | 714/752 |
| 7,110,941 | B2 * | 9/2006 | Li | 704/200.1 |
| 7,286,571 | B2 * | 10/2007 | Mailhot et al. | 370/537 |
| 7,299,190 | B2 * | 11/2007 | Thumpudi | G10L 19/032 704/200.1 |
| 7,672,743 | B2 * | 3/2010 | Messer | G10L 19/167 370/474 |
| 7,778,718 | B2 * | 8/2010 | Janke | H04R 3/04 375/229 |
| 7,782,993 | B2 * | 8/2010 | Lesser et al. | 375/371 |
| 8,229,136 | B2 * | 7/2012 | Bongiovi | H03G 9/005 381/100 |
| 8,451,311 | B2 * | 5/2013 | Miali | 348/14.01 |
| 8,472,642 | B2 * | 6/2013 | Bongiovi | H03G 9/18 333/28 R |

(Continued)

FOREIGN PATENT DOCUMENTS

EP 1 400 955 A2 3/2004

*Primary Examiner* — Gerald Gauthier
(74) *Attorney, Agent, or Firm* — Birch, Stewart, Kolasch & Birch, LLP

(57) ABSTRACT

Provided are methods and systems for rearranging a multichannel audio signal into sub-signals and allocating bit rates among them, such that compressing the sub-signals with a set of audio codecs at the allocated bit rates yields an optimal fidelity with respect to the original multichannel audio signal. Rearranging the multichannel audio signal into sub-signals and assigning each sub-signal a bit rate may be optimized according to a criterion. Existing audio codecs may be used to quantize the sub-signals at the assigned bit rates and the compressed sub-signals may be combined into the original format according to the manner in which the original multichannel audio signal is rearranged.

30 Claims, 5 Drawing Sheets

(56) References Cited

U.S. PATENT DOCUMENTS 8,565,449 B2 * 10/2013 Bongiovi ..... G10L 21/0208 333/28 R
8,705,765 B2 * 4/2014 Bongiovi ..... H04L 25/03012 381/103
8,793,282 B2 * 7/2014 Hedinsson et al. ..... 707/796
9,195,433 B2 * 11/2015 Bongiovi ..... G06F 3/165
9,276,542 B2 * 3/2016 Bongiovi ..... H03G 3/20
2003/0007516 A1 * 1/2003 Abramov et al. ..... 370/535
2004/0044527 A1 3/2004 Thumpudi et al.
2005/0213502 A1 * 9/2005 Convertino et al. ..... 370/229
2008/0167880 A1 * 7/2008 Seo ..... G10L 19/008 704/500
2009/0228284 A1 * 9/2009 Moon ..... G10L 19/035 704/500
2011/0038423 A1 * 2/2011 Lee ..... G10L 19/008 375/240.26
2011/0040556 A1 * 2/2011 Moon ..... G10L 19/008 704/205
2011/0046759 A1 * 2/2011 Kim ..... G10L 21/0272 700/94
2011/0046963 A1 * 2/2011 Kim ..... G10L 19/008 704/500
2011/0046964 A1 * 2/2011 Moon ..... G10L 19/008 704/500
2011/0060599 A1 * 3/2011 Kim ..... H04S 7/30 704/501
2013/0083843 A1 * 4/2013 Bennett ..... 375/240.02
2014/0207473 A1 * 7/2014 Li et al. ..... 704/500
2014/0244607 A1 * 8/2014 Hedinsson et al. ..... 707/705
2014/0316789 A1 * 10/2014 Lowe et al. ..... 704/500

* cited by examiner

REARRANGEMENT AND RATE ALLOCATION FOR COMPRESSING MULTICHANNEL AUDIO

TECHNICAL FIELD

The present disclosure generally relates to methods and systems for processing audio signals. More specifically, aspects of the present disclosure relate to multichannel audio compression using optimal signal rearrangement and rate allocation.

BACKGROUND

Most existing audio codecs perform well on audio signals with specific configurations, such as mono, stereo, etc. However, for other types of audio signals (e.g., an arbitrary number of channels) it is usually necessary to manually rearrange the signal into sub-signals, each of which abides by an allowed configuration, manually allocate the total bit rates among the sub-signals, and then compress the sub-signals with an existing audio codec.

Lack of guidelines in these conventional approaches to signal rearrangement and bit allocation makes things difficult for non-experts and also usually leads to suboptimal performance.

SUMMARY

This Summary introduces a selection of concepts in a simplified form in order to provide a basic understanding of some aspects of the present disclosure. This Summary is not an extensive overview of the disclosure, and is not intended to identify key or critical elements of the disclosure or to delineate the scope of the disclosure. This Summary merely presents some of the concepts of the disclosure as a prelude to the Detailed Description provided below.

One embodiment of the present disclosure relates to a method for compressing a multichannel audio signal, the method comprising: rearranging the multichannel audio signal into a plurality of sub-signals; allocating a bit rate to each of the sub-signals; quantizing the plurality of sub-signals at the allocated bit rates using at least one audio codec; and combining the quantized sub-signals according to the rearrangement of the multichannel audio signal, wherein the rearrangement of the multichannel audio signal and the allocation of the bit rates to each of the sub-signals are optimized according to a criterion.

In another embodiment, the method for compressing a multichannel audio signal further comprises selecting a sub-signal set that minimizes rate given distortion in an approximate computation.

In yet another embodiment, the method for compressing a multichannel audio signal further comprises selecting a sub-signal set that minimizes distortion given rate in an approximate computation.

In still another embodiment, the method for compressing a multichannel audio signal further comprises accounting for perception by using pre- and post-processing.

In another embodiment of the method for compressing a multichannel audio signal, the step of rearranging the multichannel audio signal into the plurality of sub-signals includes selecting a signal rearrangement, from a plurality of candidate signal rearrangements, that yields the minimum sum of entropy rates for the sub-signals.

In another embodiment of the method for compressing a multichannel audio signal, the step of rearranging the multichannel audio signal into the plurality of sub-signals includes finding the channel matching that yields the minimum sum of entropy rates for the sub-signals.

Another embodiment of the present disclosure relates to a method comprising: modifying a multichannel audio signal to account for perception; for each segment of the multichannel audio signal: estimating at least one spectral density of the modified signal; calculating entropy rates for candidate sub-signals; determining optimal bit rate allocations for candidate signal rearrangements; and obtaining, for each optimal bit rate allocation, a corresponding distortion measure; and selecting the candidate signal rearrangement that leads to the lowest average distortion.

In another embodiment, the method further comprises: rearranging the multichannel audio signal according to the selected signal rearrangement; and generating an average bit rate allocation for the rearranged signal.

In still another embodiment, the method further comprises quantizing the rearranged signal at the averaged bit rate using at least one audio codec.

Another embodiment of the present disclosure relates to a method comprising: modifying a multichannel audio signal to account for perception; for each segment of the multichannel audio signal: estimating at least one spectral density of the modified signal; and calculating entropy rates for candidate sub-signals; selecting a signal rearrangement, from a plurality of candidate signal rearrangements, that yields the minimum sum of entropy rates for the candidate sub-signals; and allocating a bit rate to the selected signal rearrangement, wherein the allocation of the bit rate is optimized according to a criterion.

In another embodiment of the method, the step of selecting the signal rearrangement includes finding the channel matching that yields the minimum sum of entropy rates for the candidate sub-signals.

Still another embodiment of the present disclosure relates to a method for compressing a multichannel audio signal, the method comprising: dividing the multichannel audio signal into overlapping segments; modifying the multichannel audio signal to account for perception; extracting spectral densities from the channels of the modified signal; calculating entropy rates of candidate sub-signals; obtaining an average of the entropy rates for a portion of audio; selecting a signal rearrangement, from a plurality of candidate signal rearrangements, for the portion of audio; and allocating a bit rate to the selected signal rearrangement, wherein the allocation of the bit rate is optimized according to a criterion.

In another embodiment, the method for compressing a multichannel audio signal further comprises filtering each channel in each segment of the signal using the auto-regressive model of that channel and at least one parameter; and normalizing all of the channels in each segment against the total power of the respective segment.

In one or more other embodiments, the methods presented herein may optionally include one or more of the following additional features: the distortion is a squared error criterion; the distortion is a weighted squared error criterion; the rate is a sum of average rates of each of the sub-signals in the set; each of the sub-signals is quantized using legacy coders; stereo sub-signals are quantized by summing and subtracting the two channels, and coding the result with two single-channel coders operating at different mean rates; the rate-distortion relation of individual sub-signals for the approximate computation is based on a Gaussianity assumption; a blossom algorithm is used to find the channel matching that yields the minimum sum of entropy rates; modifying the multichannel audio signal to account for perception is based on an auto-regressive model for each channel in each segment of the signal; the auto-regressive model is obtained using Levinson-Durbin recursion; and/or the at least one audio codec is configured for stereo signals.

Further scope of applicability of the present disclosure will become apparent from the Detailed Description given below. However, it should be understood that the Detailed Description and specific examples, while indicating preferred embodiments, are given by way of illustration only, since various changes and modifications within the spirit and scope of the disclosure will become apparent to those skilled in the art from this Detailed Description.

BRIEF DESCRIPTION OF DRAWINGS

These and other objects, features and characteristics of the present disclosure will become more apparent to those skilled in the art from a study of the following Detailed Description in conjunction with the appended claims and drawings, all of which form a part of this specification. In the drawings:

Figure 1:
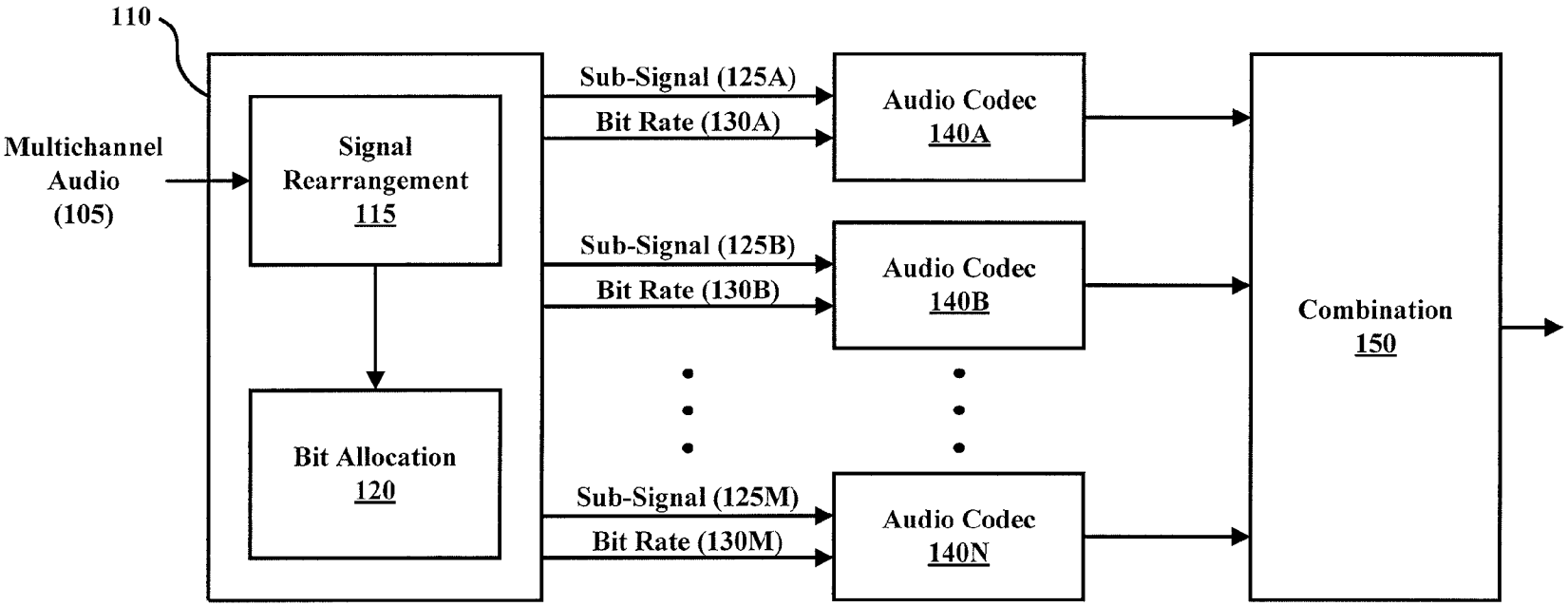
FIG. 1 is a block diagram illustrating an example system for multichannel audio compression using optimized signal rearrangement and rate allocation according to one or more embodiments described herein.

The headings provided herein are for convenience only and do not necessarily affect the scope or meaning of what is claimed in the present disclosure.

In the drawings, the same reference numerals and any acronyms identify elements or acts with the same or similar structure or functionality for ease of understanding and convenience. The drawings will be described in detail in the course of the following Detailed Description.

DETAILED DESCRIPTION

Various examples and embodiments will now be described. The following description provides specific details for a thorough understanding and enabling description of these examples. One skilled in the relevant art will understand, however, that one or more embodiments described herein may be practiced without many of these details. Likewise, one skilled in the relevant art will also understand that one or more embodiments of the present disclosure can include many other obvious features not described in detail herein. Additionally, some well-known structures or functions may not be shown or described in detail below, so as to avoid unnecessarily obscuring the relevant description.

1. Overview

Embodiments of the present disclosure relate to methods and systems for rearranging a multichannel audio signal into sub-signals and allocating bit rates among them, such that compressing the sub-signals with a set of audio codecs at the allocated bit rates yields an optimal fidelity with respect to the original multichannel audio signal. As will be further described herein, rearranging the multichannel audio signal into sub-signals and assigning each sub-signal a bit rate may be optimized according to a criterion. In at least one embodiment, existing audio codecs may be used to quantize the sub-signals at the assigned bit rates and the compressed sub-signals may be combined into the original format according to the manner in which the original multichannel audio signal is rearranged.

As compared with existing approaches to multichannel audio compression, which include exploiting the irrelevancy and redundancy among all channels, the present disclosure provides a solution that is much easier to implement.

FIG. 1 illustrates an example system for multichannel audio compression using optimized signal rearrangement and rate allocation according to one or more embodiments described herein.

A multichannel audio signal 105 may be input into a compression optimization engine 110, which may include a signal rearrangement unit 115 and a bit allocation unit 120. The compression optimization engine 110 may output sub-signals 125A, 125B, through 125M (where "M" is an arbitrary number) along with corresponding bit rates 130A, 130B, through 130M that have been assigned according to at least one perceptual criterion. Audio codecs 140A, 140B, through 140N (where "N" is an arbitrary number) may then quantize the sub-signals 125A, 125B, through 125M at the assigned bit rates 130A, 130B, through 130M.

The example system illustrated in FIG. 1 includes the signal rearrangement and rate allocation algorithm being implemented by the compression optimization engine 110 (e.g., via the signal rearrangement unit 115 and the bit allocation unit 120), which is a separate component from the audio codecs 140A, 140B, through 140N. Such an arrangement allows different audio codecs to be applied (as audio codecs 140A, 140B, through 140N) and is also relatively easy to implement. It should be understood, however, that in one or more other embodiments, the signal rearrangement and rate allocation algorithm may also be integrated into one or more of the audio codecs 140A, 140B, through 140N in addition to or instead of being implemented by a separate component of the system.

Following compression by the audio codecs 140A, 140B, through 140N, the compressed sub-signals may be combined back into the original format by a combination component 150. In at least one embodiment, the combination component 150 may recombine the compressed sub-signals according to the manner in which the original multichannel audio signal 105 is rearranged.

Figure 2:
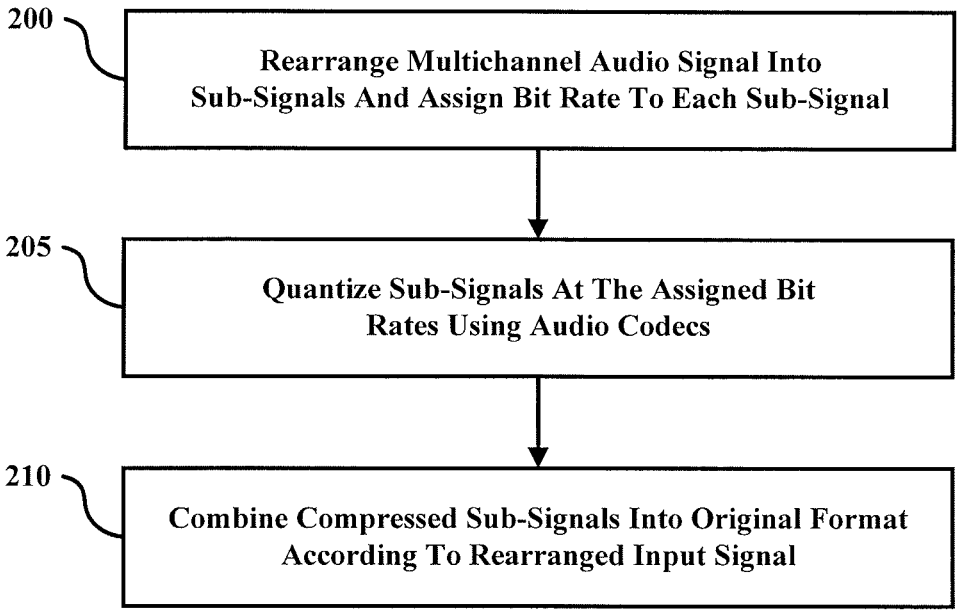
FIG. 2 is a flowchart illustrating an example method for multichannel audio compression using optimized signal rearrangement and rate allocation according to one or more embodiments described herein.

FIG. 2 is a high-level illustration of an example process for multichannel audio compression using optimized signal rearrangement and rate allocation according to one or more embodiments described herein.

At block 200, a multichannel audio signal may be rearranged into sub-signals (e.g., multichannel audio signal 105 may be rearranged into sub-signals 125A, 125B, through 125M as shown in the example system of FIG. 1). At block 205, each of the sub-signals may be assigned a bit rate (e.g., bit rates 130A, 130B, through 130M as shown in FIG. 1). As will be described in greater detail below, the signal rearrangement and rate allocation may be optimized according to a criterion (e.g., overall rate-distortion performance).

At block 210, the sub-signals may be quantized at the assigned bit rates using existing audio codecs. The process then moves to block 215, where the compressed sub-signals may be combined into the original format according to the way in which the original multichannel signal is rearranged. Additional details about the process illustrated in FIG. 2 will be provided herein.

2. Problem Statement

As described above, conventional approaches to multichannel audio compression typically include manual signal rearrangement and rate allocation according to rule-of-thumb, which is very complex and difficult for most people who are not experts in the field. As compared with such conventional approaches, the methods and systems for determining optimal signal rearrangement and rate allocation presented herein offer improved performance and user-friendliness, as will be described in greater detail below.

Several mathematical conventions and notations will be used throughout the following description. The original multichannel audio signal is denoted as s, consisting of L channels $s_1, s_2, \ldots, s_L$ (where "L" is an arbitrary number). The original signal s may be rearranged into sub-signals $g_1, g_2, \ldots, g_n$ (where "n" is an arbitrary number), each of which is a subset of the original L channels, for example, $g_k=\{s_i: i\in I_k\subseteq\{1, 2, \ldots, L\}\}$. Index sets $\{I_k\}$ form a rearrangement, satisfying $I_a\cap I_b=\emptyset$, $\forall a\neq b$ and $\cup_{k=1}^{n} I_k=\{1, 2, \ldots, L\}$. Additionally, the cardinality of $I_k$ is denoted as $|I_k|$.

An existing audio codec may be applied to compress a sub-signal at a certain bit rate, yielding a bit stream that can be used to reconstruct the sub-signal. Let function $\hat{g}_k=q_k(g_k,r_k)$ denote the reconstruction of $g_k$ by applying codec $q_k$ at bit rate $r_k$. Compression of audio signals is generally lossy, meaning that $\hat{g}_k$ does not equal $g_k$. The difference is usually quantified by a distortion measure. The following considers a global distortion measure that takes all involved codecs into account:

$$d\left(\bigcup_{k=1}^{n}\hat{g}_k; s\right).$$

The problem of rearranging a multichannel audio signal for optimal compression is to find $g_k$ (or equivalently $I_k$) together with $r_k$, which minimize the global distortion, subject to a total budget of bit rate. Mathematically, this problem may be formulated as $$\begin{aligned} &\min_{g_k, r_k} d\left(\bigcup_{k=1}^{n} q_k(g_k, r_k); s\right) \\ &\text{s.t. } \sum_{k=1}^{n} r_k \leq R \\ &r_k \geq 0. \end{aligned} \tag{1}$$

In scenarios where it is desired to minimize the bit rate given a distortion level, the problem may be expressed as $$\begin{aligned} &\min_{g_k, r_k} \sum_{k=1}^{n} r_k \\ &\text{s.t. } d\left(\bigcup_{k=1}^{n} q_k(g_k, r_k); s\right) \leq D \\ &r_k \geq 0. \end{aligned} \tag{2}$$

The problem as expressed in equation set (2) conjugates to the expression in equation set (1), and may be solved using similar techniques. The present disclosure focuses on the problem as expressed in equation set (1).

To simplify the signal rearrangement and rate allocation problem, and also propose a solution, several assumptions are made, as further described below.

3. Proposed Solution

According to at least one embodiment, a first assumption is that the global distortion is additive. In particular, $$d\left(\bigcup_{k=1}^{n}\hat{g}_k; s\right) = \sum_{k=1}^{n} d_k(\hat{g}_k; g_k). \tag{3}$$

The assumption presented in equation (3) is reasonable since often-used distortion measures for audio compression (e.g., weighted mean squared errors (MSE)) are additive. With this assumption, the original problem presented in equation (1) may be divided into smaller problems, each of which optimizes for a sub-signal.

A second assumption arises because the distortion is difficult to analyze since it is determined by the characteristics of particular audio codecs. Accordingly, the following description considers the optimal distortion from the information theoretic viewpoint and generalizes the distortion to a more realistic expression.

A. Optimal Distortion

The following considers the optimal distortion that an audio codec can achieve. Such a codec may be applied to a sub-signal from the previous context described above. For simplicity, the following description reduces the notion of a sub-signal and considers the optimal compression of a c channel signal (where "c" is an arbitrary number).

The minimum distortion of compressing a multichannel audio signal at an arbitrary bit rate may be derived from the information theoretical viewpoint. A multidimensional Gaussian process may be used to model a multichannel audio signal, which can represent any sub-signal in the earlier context. Such an assumption may be valid for audio segments of, for example, some tens of milliseconds. Accordingly, the methods and systems described herein may be applied to real audio signals frame-by-frame.

A multidimensional Gaussian process can be characterized by its spectral matrix $$S(\omega) = \begin{bmatrix} S^{1,1}(\omega) & S^{1,2}(\omega) & \ldots & S^{1,c}(\omega) \\ S^{2,1}(\omega) & S^{2,2}(\omega) & \ldots & S^{2,c}(\omega) \\ \vdots & \vdots & \ddots & \vdots \\ S^{c,1}(\omega) & S^{c,2}(\omega) & \ldots & S^{c,c}(\omega) \end{bmatrix}. \tag{4}$$

In the spectral matrix (4) above, which is used for the multidimensional Gaussian process, the diagonal elements are the self power-spectral-densities (PSDs) of the individual channels in the multidimensional Gaussian process, and the off-diagonal elements are the cross PSDs, which satisfy $S^{i,j}(\omega)=\overline{S}^{j,i}(\omega)$.

If the MSE is considered as the distortion measure, the minimum distortion achievable at bit rate r follows a parametric expression with parameter $\eta$:

$$d(r) = \frac{1}{2\pi}\int_{-\pi}^{\pi}\sum_{k=1}^{c}\min\{\eta, \lambda_k(S(\omega))\}\,d\omega, \tag{5}$$

and $$r = \frac{1}{4\pi}\int_{-\pi}^{\pi}\sum_{k=1}^{c}\max\left\{0, \log_2\frac{\lambda_k(S(\omega))}{\eta}\right\}d\omega, \tag{6}$$

where $\lambda_k(S(\omega))$ represents the k-th eigenvalue (actually a function of $\omega$) of the spectral matrix.

The above calculation shown in equation (6) may be further simplified by assuming that $\lambda_k(S(\omega))\geq\eta,\forall\omega,k$. This assumption is valid, for example, when the overall distortion level is sufficiently low, which will depend on the dynamic range of the power spectrum and, importantly, on the perceptual weighting. In other words, the above assumption works well because of proper perceptual weighting, which reduces the dynamic range of the power spectrum. With this assumption, it becomes clear that $$d(r) = c2^{\frac{1}{2\pi c}\int_{-\pi}^{\pi}\log_2\det(S(\omega))\,d\omega}2^{\frac{2r}{c}}. \tag{7}$$

In equation (7) above, $$\frac{1}{2\pi c}\int_{-\pi}^{\pi}\log_2\det(S(\omega))\,d\omega$$

is related to the entropy rate of the multivariate Gaussian process. In other words $$h(S(\omega)) = \frac{1}{4\pi}\int_{-\pi}^{\pi}\log_2\det(S(\omega))\,d\omega. \tag{8}$$

The relation shown above in equation (8) then leads to $$d(r) = c2^{\frac{2}{c}(h(S(\omega))-r)}. \tag{9}$$

For a practical audio codec, the distortion may be assumed to follow a generalized form:

$$d(r) = f(r)2^{\frac{2h(S(\omega))}{c}}. \tag{10}$$

where f(r) is a rate function associated with the codec. Accordingly, the optimal rate function is $$f(r) = c2^{-\frac{2r}{c}}.$$

It should be noted that in practical audio coding, distortion measures usually account for perceptual effects, which were not considered in the above description. Many perceptual effects may be taken into account by modifying the input signal according to a perceptual criterion, and then applying a simple distortion measure on the modified signal. Additional details about modifying the input signal according to a perceptual criterion will be provided below in the "Example Application."

B. Optimal Rearrangement and Rate Allocation

With the more generalized expression for optimal distortion developed in the previous section, the following describes additional details of the method for determining the optimal rearrangement and rate allocation for a multichannel audio signal according to one or more embodiments of the present disclosure. As will be further described below, at least one embodiment of the method addresses the following: (1) given a signal rearrangement, determine the optimal rate allocation, and (2) determine the optimal signal rearrangement.

Given a rearrangement of the original multichannel audio signal, allow $S_k(\omega)$ to denote the spectral matrix of the k-th sub-signal and $f_k(r)$ to denote the rate function associated with the k-th audio codec. The first part of the problem then becomes $$\begin{aligned} &\min_{g_k, r_k} \quad \sum_{k=1}^{n} f(r_k)2^{\frac{2h(S_k(\omega))}{c}} \\ &\text{s.t.} \quad \sum_{k=1}^{n} r_k \leq R \\ &\qquad r_k \geq 0. \end{aligned} \tag{11}$$

In some scenarios, the optimal bit allocation then satisfies $$\frac{d f_k(r)}{dr} \propto 2^{-\frac{2h(S(\omega))}{|I_k|}}. \tag{12}$$

Figure 3:
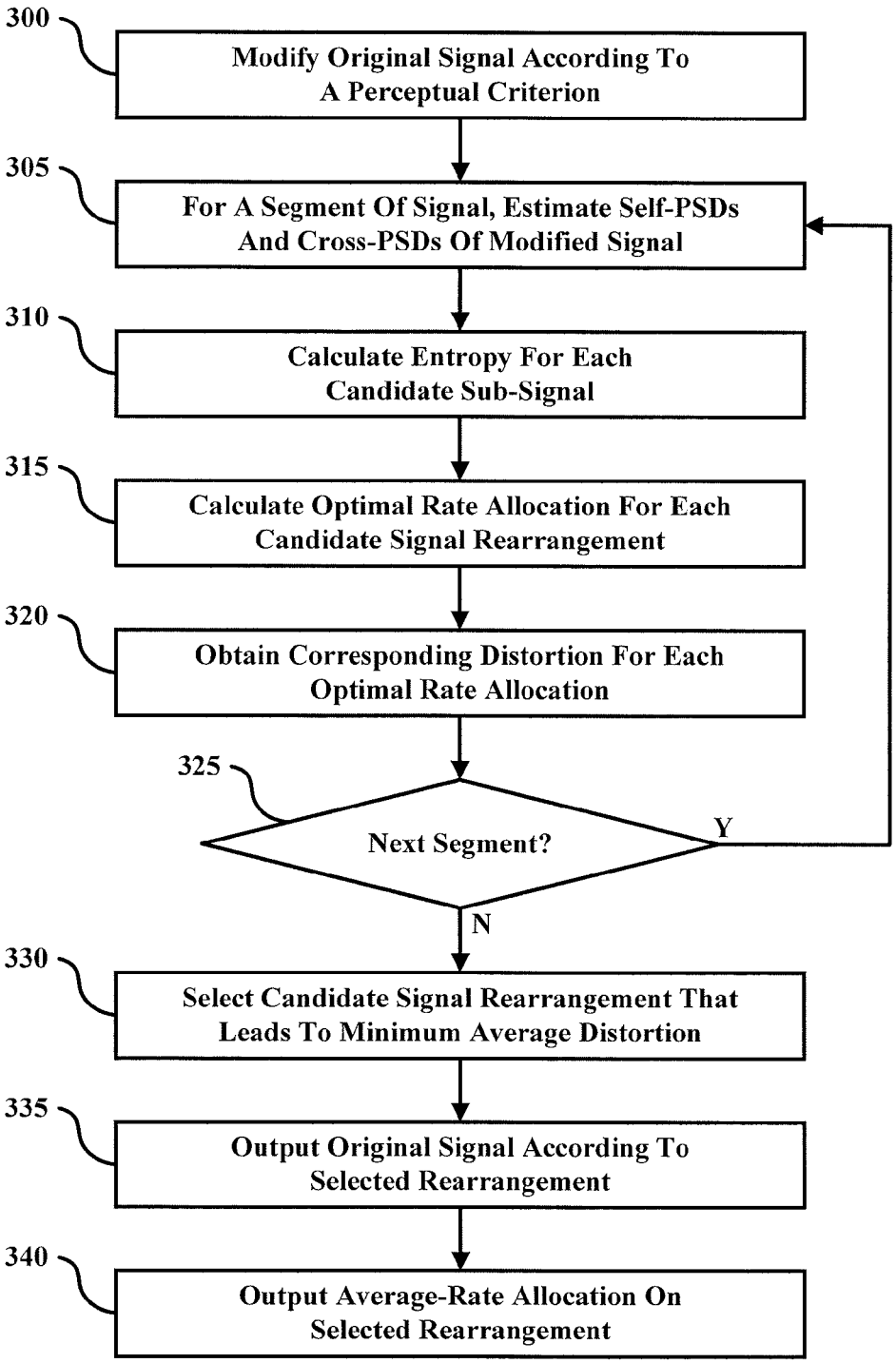
FIG. 3 is a flowchart illustrating an example method for signal rearrangement and rate allocation of a multichannel audio signal according to one or more embodiments described herein.

FIG. 3 illustrates an example process for determining optimal signal rearrangement and rate allocation, with consideration given to a perceptually-weighted distortion measure, according to at least one embodiment of the disclosure.

At block 300, the original multichannel audio signal (e.g., multichannel audio signal 105 as shown in FIG. 1) may be modified according to one or more perceptual criterion.

At block 305, the process may estimate, for a segment of the signal, self-PSDs and cross-PSDs of the modified signal from block 300.

At block 310, entropy rates may be calculated for candidate sub-signals.

At block 315, a bit rates may be allocated to each of the candidate signal rearrangements, where the allocation of the bit rates is optimized according to a criterion.

For each of the optimal bit rates allocated at block 315, a corresponding distortion may be obtained in block 320.

At block 325, a determination may be made as to whether there is a next segment still to be considered in the multi-segment signal. In a scenario where there is a next segment in the signal, the process may move from block 325 to block 305 where, for the next segment of the signal, estimates may be obtained for self-PSDs and cross-PSDs of the modified signal, as described above. If it is determined at block 325 that the signal does not include any more segments to be considered, the process may move to block 330 where a selection may be made of the candidate signal rearrangement that leads to the minimum average distortion.

At block 335, the original audio signal may be output according to the signal rearrangement selected at block 330 (e.g., the signal rearrangement that leads to the minimum average distortion), and at block 340 the average-rate allocation on the selected rearrangement may be output.

A special case is when the rate function is optimal for MSE. For example, where $$f_k(r) = |I_k|2^{-\frac{2r}{|I_k|}},$$

it is relatively straightforward to show that the optimal bit rate allocated to the k-th sub-signal is $$r_k = |I_k|T + h(S_k(\omega)), \tag{13}$$

where t is a constant offset, which is simply $$T = \frac{1}{L}\left(R - \sum_{k=1}^{n} h(S_k(\omega))\right). \tag{14}$$

Given the above, $$d\left(\bigcup_{k=1}^{n} \hat{g}_k; s\right) = \sum_{k=1}^{n} |I_k|2^{-\frac{2T}{|I_k|}}. \tag{15}$$

For a fixed set of $|I_k|$, it is desired for T to be maximal, or equivalently $\Sigma_{k=1}^{n} h(S_k(\omega))$ to be minimal. The optimal rearrangement and bit allocation can then be obtained as further described below with reference to FIG. 4.

Figure 4:
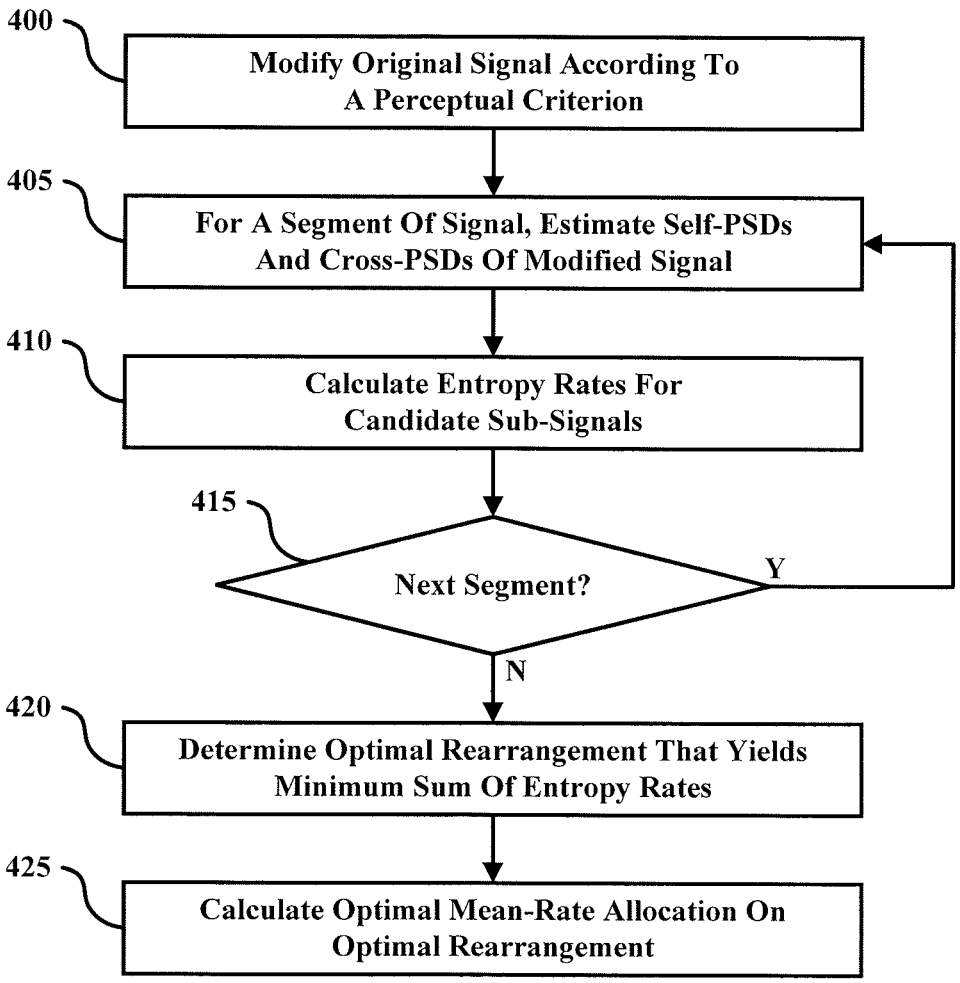
FIG. 4 is a flowchart illustrating another example method for signal rearrangement and rate allocation of a multichannel audio signal according to one or more embodiments described herein.

FIG. 4 illustrates another example process for determining optimal signal rearrangement and rate allocation according to one or more embodiments described herein. While certain blocks comprising the process illustrated in FIG. 4 may be similar to one or more blocks comprising the process illustrated in FIG. 3 (described above), other blocks may include different features between the two example processes illustrated, as described in further detail below.

At block 400, the original multichannel audio signal (e.g., multichannel audio signal 105 as shown in FIG. 1) may be modified according to one or more perceptual criterion.

At block 405, the process may estimate, for a segment of the signal, self-PSDs and cross-PSDs of the modified signal from block 400.

At block 410, entropy rates may be calculated for the candidate sub-signals using, for example, equation (8) presented above.

At block 415, a determination may be made as to whether multiple segments of the signal are present. For example, where the signal does include multiple segments, the process may move from block 415 to block 405 where, for another segment of the signal, estimates may be obtained for self-PSDs and cross-PSDs of the modified signal from block 400, as described above.

If it is found at block 415 that the signal does not include multiple segments, the process may move to block 420 where the signal rearrangement that yields the minimum sum of entropy rates for the candidate sub-signals may be selected as the optimal signal rearrangement.

At block 425, the optimal rate allocation may be calculated on the optimal signal rearrangement selected in block 420.

It may be verified that finding the maximum T is also the solution to the case where the rate function is with a constant factor of the optimal rate function. For example, where $$f_k(r) = K|I_k|2^{-\frac{2r}{|I_k|}}.$$

Such a constant factor K may stem from, for example, the use of non-optimal quantizers inside the codec (in contrast to an unrealizable optimal quantizer that is used to derive the optimal rate function).

C. Alternate Arrangement

Consider a scenario where a stereo audio codec may be used to compress an L-channel multichannel audio signal (where "L" is an arbitrary number). When L is an even number, the source channels may be rearranged into L/2 pairs of channels. As such, there will be L(L−1)/2 candidate pairs of channels. On the other hand, if L is an odd number, in addition to L(L−1)/2 pairs, a channel must also be compressed monophonically. In such a case, the candidate sub-signals may include all pairs and all original channels. Since the number of sub-signals and the sizes of sub-signals are fixed in any given rearrangement, the algorithm illustrated in FIG. 4 and described above may be used to determine the optimal signal rearrangement and bit allocation. Additional implementation details for such a scenario are provided below.

In block 410 of the process illustrated in FIG. 4, the entropy rate for a mono candidate sub-signal may be calculated as $$h(S_k(\omega)) = \frac{1}{4\pi}\int_{-\pi}^{\pi} \log_2 S_k(\omega)\, d\omega. \tag{16}$$

Additionally, for a stereo sub-signal the entropy rate may be calculated as $$h(S_k(\omega)) = \frac{1}{4\pi}\int_{-\pi}^{\pi} \log_2\left(S_k^{1,1}(\omega)S_k^{2,2}(\omega) - |S_k^{1,2}(\omega)|^2\right) d\omega. \tag{17}$$

It should be noted that equations (16) and (17) are each only an example of one way to calculate the entropy rate for a mono and stereo candidate sub-signal, respectively, by making a Gaussian assumption.

Further, in block 420 of the process illustrated in FIG. 4, the optimal rearrangement may be determined by the perfect matching of channels that yields the minimum sum of entropy rates. In at least one implementation, the optimal rearrangement may be determined using a matching algorithm (e.g., the blossom algorithm). In an implementation where a suboptimal solution is acceptable, less computationally complex methods may be utilized in block 420 (e.g., greedy search).

4. Example Embodiment

The following example further illustrates the method for determining optimal signal rearrangement and rate allocation of a multichannel audio signal according to at least one embodiment of the present disclosure. The scenario presented below is entirely illustrative in nature, and is not intended to limit the scope of the present disclosure in any manner.

In the following example, the aim is to compress a 5-channel 48 kHz sampled audio signal at 130 kbps, using a codec that only handles stereo and mono signals. Accordingly, the original signal may be rearranged into three sub-signals, two of which are stereo and the third of which is mono (e.g., two pairs of channels plus one individual channel). Rates may be allocated to the three sub-signals using a process similar to that described above and illustrated in FIG. 4.

The original signal may be divided into segments of 40 milliseconds, where segments are overlapped by 20 milliseconds. In the present example, a simple perceptual criterion (e.g., overall rate-distortion performance) may be used to modify the signal. The criterion is based on an auto-regressive model for each channel in each segment. A standard method such as the Levinson-Durbin recursion can be used to obtain such a model. Every channel may then undergo a filtering with a filter with transfer function $A(z/\gamma_1)/A(z/\gamma_2)$, where $A(z)$ represents the auto-regressive model of the particular channel, and the two parameters, $\gamma_1$ and $\gamma_2$, can take, for example, the values 0.9 and 0.6, respectively. This perceptual criterion is known as the $\gamma_1$-$\gamma_2$ model. In addition to the $\gamma_1$-$\gamma_2$ model, all of the channels in each segment may be normalized against the total power of that segment, after the filtering. This operation takes the changes of signal power over time into the distortion measure. At the decoder, the power weighting and the perceptual weighting may be undone by renormalization and by filtering with the corresponding inverse filter.

It should be noted that the perceptual criterion described above ($\gamma_1$-$\gamma_2$ model) is only one example of a perceptual criterion that may be utilized in accordance with the methods and systems of the present disclosure. Depending on the particular implementation, one or more other perceptual criteria may also be utilized in addition to or instead of the example criterion described above.

After the modification of the original signal to account for perception, self-PSDs and cross-PSDs may be extracted from the channels using any of a variety of methods known to those skilled in the art. For example, the periodogram method may be used to extract the self-PSDs and cross-PSDs.

With the extracted self-PSDs and cross-PSDs, the entropy rates of candidate sub-signals may then be calculated. In the present example, there are fifteen candidate sub-signals consisting of ten channel pairs and five single channels. The entropy rate for a given candidate sub-signal may be calculated using equation (16) or (17), depending on whether the sub-signal is a mono or stereo sub-signal. The entropy rates for ten seconds of audio may be collected and averaged. Then the optimal rearrangement and rate allocation may be obtained for the audio in the time span, as further described below.

In at least the present example, the blossom algorithm may be used to determine the optimal signal rearrangement. Using the blossom algorithm, a graph is constructed with six nodes, five of which correspond to a channel of the audio signal. The sixth node is designated as a dummy node. For each channel pair, the averaged entropy rate may be assigned to the edge connecting the corresponding nodes. For each single channel, the averaged entropy rate for the channel may be assigned to the edge between the dummy node and the node of the channel. Given this graph, the blossom algorithm may then yield the optimal signal rearrangement. In particular, the blossom algorithm selects non-intersecting edges with the minimum sum of entropy rates. The two nodes on each chosen edge form a sub-signal. To determine the optimal rate allocation, T may be calculated using equation (14). It should be noted that R=130/48, since it should have the same unit, bit-per-sample, as the entropy rates. Equation (13) may then be used to determine the optimal rate allocation.

Finally, the original signal within this ten second time span may be rearranged and quantized by the chosen codec at the calculated rates.

It should be noted that in one or more embodiments, other quantities may also be possible in addition to or instead of "entropy rate." For example, coding gain, in which the rate is reduced by optimal coding of all channels together as opposed to coding the channels independently.

Furthermore, perceptual effects can be captured by means other than modifying the audio signal upfront. For example, perceptual effects may be captured using "perceptual entropy" and "perceptual distortion" instead of "entropy rate" and "distortion."

Figure 5:
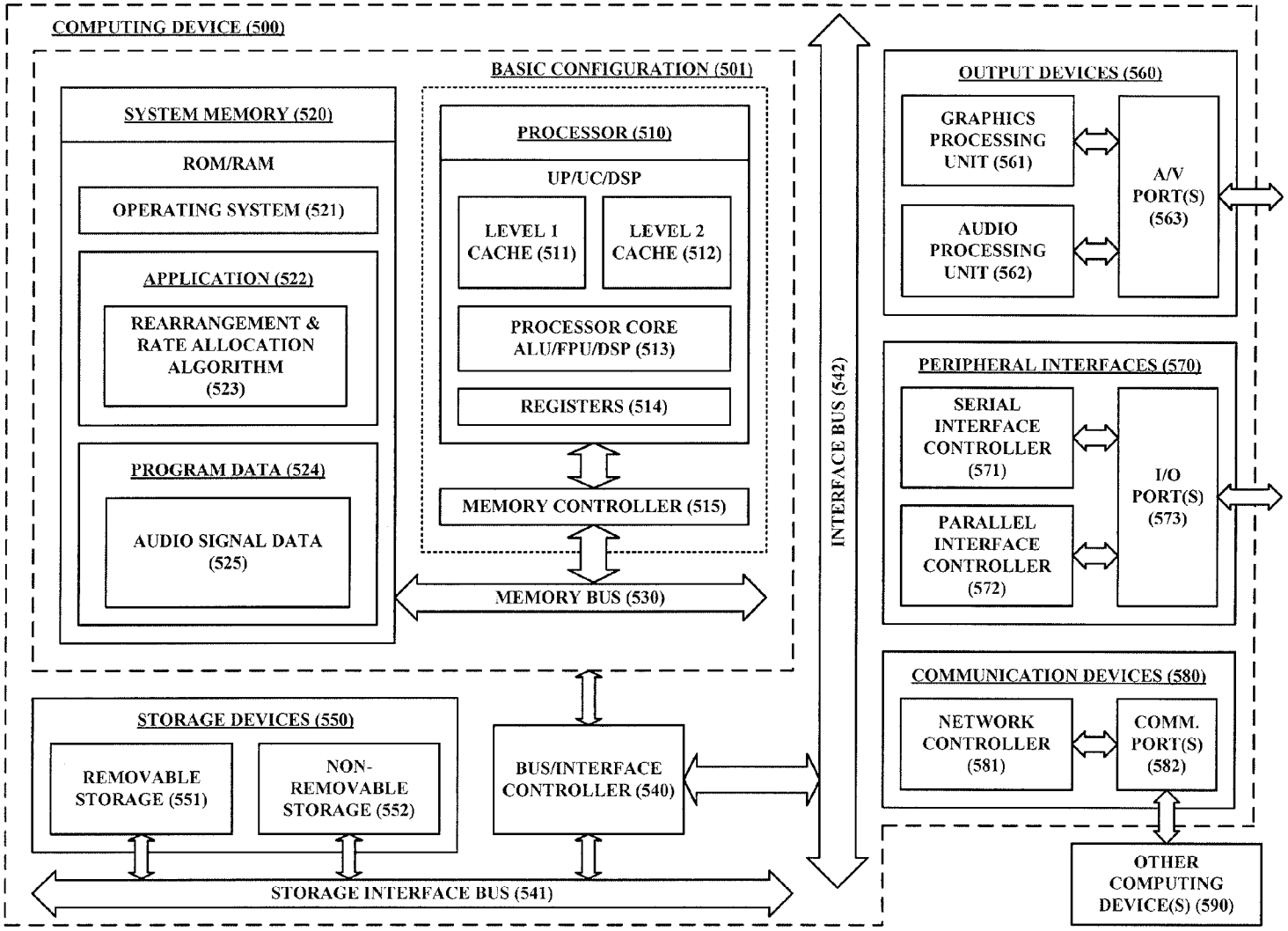
FIG. 5 is a block diagram illustrating an example computing device arranged for determining optimal signal rearrangement and rate allocation of a multichannel audio signal according to one or more embodiments described herein.

FIG. 5 is a block diagram illustrating an example computing device 500 that is arranged for determining optimal signal rearrangement and rate allocation of a multichannel audio signal in accordance with one or more embodiments of the present disclosure. For example, computing device 500 may be configured to rearrange a multichannel audio signal into sub-signals and allocate bit rates among them, such that compressing the sub-signals with a set of audio codecs at the allocated bit rates will yield an optimal fidelity with respect to the original multichannel audio signal, as described above. In accordance with at least one embodiment, the computing device 500 may further be configured to use existing audio codecs to quantize the sub-signals at the assigned bit rates and then combine the compressed sub-signals into the original format according to the manner in which the original multichannel audio signal is rearranged. In a very basic configuration 501, computing device 500 typically includes one or more processors 510 and system memory 520. A memory bus 530 may be used for communicating between the processor 510 and the system memory 520.

Depending on the desired configuration, processor 510 can be of any type including but not limited to a microprocessor (μP), a microcontroller (μC), a digital signal processor (DSP), or any combination thereof. Processor 510 may include one or more levels of caching, such as a level one cache 511 and a level two cache 512, a processor core 513, and registers 514. The processor core 513 may include an arithmetic logic unit (ALU), a floating point unit (FPU), a digital signal processing core (DSP Core), or any combination thereof. A memory controller 515 can also be used with the processor 510, or in some embodiments the memory controller 515 can be an internal part of the processor 510.

Depending on the desired configuration, the system memory 520 can be of any type including but not limited to volatile memory (e.g., RAM), non-volatile memory (e.g., ROM, flash memory, etc.) or any combination thereof. System memory 520 typically includes an operating system 521, one or more applications 522, and program data 524. In one or more embodiments, application 522 may include a rearrangement and rate allocation algorithm 523 that is configured to determine optimal signal rearrangement and rate allocation of a multichannel audio signal. For example, in one or more embodiments the rearrangement and rate allocation algorithm 523 may be configured to rearrange an original multichannel audio signal (e.g., multichannel audio signal 105 as shown in FIG. 1) into sub-signals and assign a bit rate to each of the sub-signals, where the rearrangement and the rate allocation may be optimized according to a perceptual criterion. The rearrangement and rate allocation algorithm 523 may be further configured to quantize the sub-signals at the assigned bit rates using existing audio codecs, and then combine the compressed sub-signals back into the format of the original signal according to the manner in which the original signal is rearranged.

Program Data 524 may include audio signal data 525 that is useful for determining the optimal signal rearrangement and rate allocation of a multichannel audio signal. In some embodiments, application 522 can be arranged to operate with program data 524 on an operating system 521 such that the rearrangement and rate allocation algorithm 523 uses the audio signal data 525 to modify the original signal according to a perceptual criterion and then extract self-PSDs and cross-PSDs for each segment of the modified signal.

Computing device 500 can have additional features and/or functionality, and additional interfaces to facilitate communications between the basic configuration 501 and any required devices and interfaces. For example, a bus/interface controller 540 can be used to facilitate communications between the basic configuration 501 and one or more data storage devices 550 via a storage interface bus 541. The data storage devices 550 can be removable storage devices 551, non-removable storage devices 552, or any combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), tape drives and the like. Example computer storage media can include volatile and nonvolatile, removable and non-removable media implemented in any method or technology for storage of information, such as computer readable instructions, data structures, program modules, and/or other data.

System memory 520, removable storage 551 and non-removable storage 552 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 500. Any such computer storage media can be part of computing device 500.

Computing device 500 can also include an interface bus 542 for facilitating communication from various interface devices (e.g., output interfaces, peripheral interfaces, communication interfaces, etc.) to the basic configuration 501 via the bus/interface controller 540. Example output devices 560 include a graphics processing unit 561 and an audio processing unit 562, either or both of which can be configured to communicate to various external devices such as a display or speakers via one or more A/V ports 563. Example peripheral interfaces 570 include a serial interface controller 571 or a parallel interface controller 572, which can be configured to communicate with external devices such as input devices (e.g., keyboard, mouse, pen, voice input device, touch input device, etc.) or other peripheral devices (e.g., printer, scanner, etc.) via one or more I/O ports 573.

An example communication device 580 includes a network controller 581, which can be arranged to facilitate communications with one or more other computing devices 590 over a network communication (not shown) via one or more communication ports 582. The communication connection is one example of a communication media. Communication media may typically be embodied by computer readable instructions, data structures, program modules, or other data in a modulated data signal, such as a carrier wave or other transport mechanism, and includes any information delivery media. A "modulated data signal" can be a signal that has one or more of its characteristics set or changed in such a manner as to encode information in the signal. By way of example, and not limitation, communication media can include wired media such as a wired network or direct-wired connection, and wireless media such as acoustic, radio frequency (RF), infrared (IR) and other wireless media. The term computer readable media as used herein can include both storage media and communication media.

Computing device 500 can be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. Computing device 500 can also be implemented as a personal computer including both laptop computer and non-laptop computer configurations.

There is little distinction left between hardware and software implementations of aspects of systems; the use of hardware or software is generally (but not always, in that in certain contexts the choice between hardware and software can become significant) a design choice representing cost versus efficiency trade-offs. There are various vehicles by which processes and/or systems and/or other technologies described herein can be effected (e.g., hardware, software, and/or firmware), and the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation. In one or more other scenarios, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those skilled within the art that each function and/or operation within such block diagrams, flowcharts, or examples can be implemented, individually and/or collectively, by a wide range of hardware, software, firmware, or virtually any combination thereof.

In one or more embodiments, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments described herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof. Those skilled in the art will further recognize that designing the circuitry and/or writing the code for the software and/or firmware would be well within the skill of one of skilled in the art in light of the present disclosure.

Additionally, those skilled in the art will appreciate that the mechanisms of the subject matter described herein are capable of being distributed as a program product in a variety of forms, and that an illustrative embodiment of the subject matter described herein applies regardless of the particular type of signal-bearing medium used to actually carry out the distribution. Examples of a signal-bearing medium include, but are not limited to, the following: a recordable-type medium such as a floppy disk, a hard disk drive, a Compact Disc (CD), a Digital Video Disk (DVD), a digital tape, a computer memory, etc.; and a transmission-type medium such as a digital and/or an analog communication medium (e.g., a fiber optic cable, a waveguide, a wired communications link, a wireless communication link, etc.).

Those skilled in the art will also recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. A method for compressing a multichannel audio signal, the method comprising:

rearranging the multichannel audio signal into a plurality of sub-signals;

allocating a bit rate to each of the sub-signals;

quantizing the plurality of sub-signals at the allocated bit rates using at least one audio codec; and combining the quantized sub-signals according to the rearrangement of the multichannel audio signal, wherein the rearrangement of the multichannel audio signal and the allocation of the bit rates to each of the sub-signals are optimized according to a rate-distortion criterion.

2. The method of claim 1, further comprising selecting a sub-signal set that minimizes rate given distortion in an approximate computation.

3. The method of claim 1, further comprising selecting a sub-signal set that minimizes distortion given rate in an approximate computation.

4. The method of claim 2, wherein the distortion is a squared error criterion.

5. The method of claim 2, wherein the distortion is a weighted squared error criterion.

6. The method of claim 2, wherein the rate is a sum of average rates of each of the sub-signals in the set.

7. The method of claim 1, further comprising accounting for perception by using pre- and post-processing.

8. The method of claim 1, wherein each of the sub-signals is quantized using legacy coders.

9. The method of claim 1, wherein stereo sub-signals are quantized by summing and subtracting the two channels, and coding the result with two single-channel coders operating at different mean rates.

10. The method of claim 2, wherein the rate-distortion relation of individual sub-signals for the approximate computation is of the form $$d(r) = f(r)2^{\frac{2h(S(\omega))}{c}}.$$

11. The method of claim 10, wherein the entropy rate may be calculated using $$h(S_k(\omega)) = \frac{1}{4\pi}\int_{-\pi}^{\pi}\log_2 S_k(\omega)\,d\omega.$$

12. The method of claim 2, wherein the rate-distortion relation of individual sub-signals for the approximate computation is based on a Gaussianity assumption.

13. The method of claim 1, wherein rearranging the multichannel audio signal into the plurality of sub-signals includes selecting a signal rearrangement, from a plurality of candidate signal rearrangements, that yields the minimum sum of entropy rates for the sub-signals.

14. The method of claim 1, wherein rearranging the multichannel audio signal into the plurality of sub-signals includes finding the channel matching that yields the minimum sum of entropy rates for the sub-signals.

15. The method of claim 14, wherein a blossom algorithm is used to find the channel matching that yields the minimum sum of entropy rates.

16. A method for compressing multichannel audio, the method comprising:

modifying a multichannel audio signal to account for perception;

for each segment of the modified multichannel audio signal:

estimating at least one spectral density of the modified signal;

calculating entropy rates for candidate sub-signals;

determining optimal bit rate allocations for candidate signal rearrangements; and obtaining, for each optimal bit rate allocation, a corresponding distortion measure;

selecting the candidate signal rearrangement that leads to the lowest average distortion;

rearranging the multichannel audio signal according to the selected signal rearrangement; and outputting the rearranged audio signal to at least one audio codec for compressing the rearranged audio signal at an average bit rate allocation determined for the rearranged signal.

17. The method of claim 16, further comprising:

determining the average bit rate allocation for the rearranged audio signal.

18. The method of claim 17, further comprising outputting the averaged bit rate determined for the rearranged audio signal to the at least one audio codec.

19. A method comprising:

modifying a multichannel audio signal to account for perception;

for each segment of the multichannel audio signal:

estimating at least one spectral density of the modified signal; and calculating entropy rates for candidate sub-signals;

selecting a signal rearrangement, from a plurality of candidate signal rearrangements, that yields the minimum sum of entropy rates for the candidate sub-signals;

allocating a bit rate to the selected signal rearrangement, wherein the allocation of the bit rate is optimized according to a rate-distortion criterion; and outputting the audio signal according to the selected signal rearrangement to at least one audio codec for compressing the signal at the allocated bit rate.

20. The method of claim 19, further comprising:

rearranging the multichannel audio signal according to the selected signal rearrangement; and quantizing the rearranged signal at the allocated bit rate using the at least one audio codec.

21. The method of claim 19, wherein selecting the signal rearrangement includes finding the channel matching that yields the minimum sum of entropy rates for the candidate sub-signals.

22. The method of claim 21, wherein a blossom algorithm is used to find the channel matching that yields the minimum sum of entropy rates.

23. A method for compressing a multichannel audio signal, the method comprising:

dividing the multichannel audio signal into overlapping segments;

modifying the multichannel audio signal to account for perception;

extracting spectral densities from the channels of the modified signal;

calculating entropy rates of candidate sub-signals;

obtaining an average of the entropy rates for a portion of audio;

selecting a signal rearrangement, from a plurality of candidate signal rearrangements, for the portion of audio;

allocating a bit rate to the selected signal rearrangement, wherein the allocation of the bit rate is optimized according to a rate-distortion criterion; and outputting the multichannel audio signal according to the selected signal rearrangement to at least one audio codec for compressing the signal at the allocated bit rate.

24. The method of claim 23, further comprising:

rearranging the multichannel audio signal within the portion of audio according to the selected signal rearrangement; and quantizing the rearranged signal at the allocated bit rate using the at least one audio codec.

25. The method of claim 23, wherein selecting the signal rearrangement from the plurality of candidate signal rearrangements includes finding the channel matching that yields the minimum sum of entropy rates of the candidate sub-signals.

26. The method of claim 25, further comprising using a blossom algorithm to find the channel matching that yields the minimum sum of entropy rates.

27. The method of claim 23, wherein modifying the multichannel audio signal to account for perception is based on an auto-regressive model for each channel in each segment of the signal.

28. The method of claim 27, wherein the auto-regressive model is obtained using Levinson-Durbin recursion.

29. The method of claim 27, further comprising:

filtering each channel in each segment of the signal using the auto-regressive model of that channel and at least one parameter; and normalizing all of the channels in each segment against the total power of the respective segment.

30. The method of claim 24, wherein the at least one audio codec is configured for stereo signals.

* * * * *